US010900646B2

(12) United States Patent
Yen et al.

(10) Patent No.: US 10,900,646 B2
(45) **Date of Patent: *Jan. 26, 2021**

(54) CLAMP LAMP

(71) Applicant: QISDA CORPORATION, Taoyuan (TW)

(72) Inventors: Yung-Ming Yen, New Taipei (TW); Yu-Hsuan Wang, Taipei (TW)

(73) Assignee: Qisda Corporation, Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/711,401

(22) Filed: Dec. 11, 2019

(65) Prior Publication Data

US 2020/0116337 A1 Apr. 16, 2020

Related U.S. Application Data

(63) Continuation of application No. 15/937,837, filed on Mar. 27, 2018, now Pat. No. 10,544,927.

(30) Foreign Application Priority Data

Jun. 16, 2017 (CN) ..... 2017 1 0458645

(51) Int. Cl.
*F21V 21/088* (2006.01)
*F21V 15/04* (2006.01)
*F21V 19/00* (2006.01)

(52) U.S. Cl.
CPC ..... *F21V 21/088* (2013.01); *F21V 15/04* (2013.01); *F21V 19/009* (2013.01)

(58) Field of Classification Search
CPC ..... F21V 21/088; F21V 15/04; F21V 19/009
See application file for complete search history.

(56) References Cited

U.S. PATENT DOCUMENTS

| | | | | |
|---|---|---|---|---|
| 1,542,778 A | | 6/1925 | Theodore | |
| 2,711,872 A | * | 6/1955 | Lampke | A61J 9/0638 248/103 |
| 2,876,027 A | * | 3/1959 | Sulmonetti | F16B 2/10 403/53 |
| 3,030,681 A | * | 4/1962 | Phillips | G09F 3/16 248/229.15 |
| 5,180,220 A | * | 1/1993 | Van Kalsbeek | F21V 21/088 362/253 |

(Continued)

FOREIGN PATENT DOCUMENTS

| | | |
|---|---|---|
| CN | 102263888 A | 11/2011 |
| CN | 202035067 U | 11/2011 |

(Continued)

*Primary Examiner* — Anabel Ton

(57) ABSTRACT

A clamp lamp uses two clamping parts to clamp an outer casing of a monitor stably. In an embodiment, the clamp lamp also uses a C-shaped resilient clip for convenience of clamping a light source thereof. In another embodiment, the clamp lamp also uses a C-shaped resilient clip for convenience of clamping a light source thereof, and a resilient part for assisting the clamping. In another embodiment, the clamp lamp also uses the two clamping parts to clamp the outer casing by touching front and rear surfaces of the outer casing simultaneously; therein, the portion of one clamping part that touches the front surface is shorter than the portion of the other clamping part that touches the rear surface.

20 Claims, 8 Drawing Sheets

(56) References Cited

U.S. PATENT DOCUMENTS

| | | | | |
|---|---|---|---|---|
| 5,379,201 | A * | 1/1995 | Friedman | F21V 33/0052 362/191 |
| 5,515,246 | A | 5/1996 | Maglica | |
| 5,739,750 | A | 4/1998 | Drake | |
| 6,711,006 | B2 * | 3/2004 | Chen | F16M 11/14 248/231.31 |
| 6,764,194 | B1 * | 7/2004 | Cooper | F21V 21/084 362/103 |
| 7,946,547 | B2 * | 5/2011 | Bernstorf | H01B 17/06 248/229.22 |
| 8,387,939 | B2 | 3/2013 | Ford | |
| 9,583,977 | B1 * | 2/2017 | Beranek | F21S 9/024 |
| 10,544,927 | B2 * | 1/2020 | Yen | F21V 15/04 |
| 2003/0184996 | A1 * | 10/2003 | Marshall | A45D 42/16 362/144 |
| 2003/0227770 | A1 * | 12/2003 | Chen | F21V 33/0052 362/85 |
| 2006/0003119 | A1 | 1/2006 | Aiba | |
| 2006/0072328 | A1 * | 4/2006 | Chan | F21V 21/26 362/382 |
| 2007/0109803 | A1 | 5/2007 | Chuang | |
| 2009/0135619 | A1 | 5/2009 | Hung | |
| 2011/0075403 | A1 | 3/2011 | Niezrecki | |
| 2012/0075874 | A1 | 3/2012 | Sherwin | |
| 2013/0272004 | A1 | 10/2013 | Tsai | |

FOREIGN PATENT DOCUMENTS

| | | | |
|---|---|---|---|
| CN | 202580667 | U | 12/2012 |
| CN | 103582855 | A | 2/2014 |
| CN | 1868419 | B | 4/2015 |
| CN | 204806175 | U | 11/2015 |
| TW | M423787 | U1 | 3/2012 |
| TW | M461745 | U1 | 9/2013 |

* cited by examiner

CLAMP LAMP

CROSS REFERENCE TO RELATED APPLICATIONS

This application is a continuation of application Ser. No. 15/937,837, filed Mar. 27, 2018.

BACKGROUND OF THE INVENTION

1. Field of the Invention

The invention relates to an illumination device, and especially relates to a clamp lamp capable of clamping a side of a monitor.

2. Description of the Prior Art

Conventional illumination devices are usually immobile and have a relatively large volume, such as drop lights, recessed lights, table lights and so on. For cases in which a user just needs local illumination or intensive illumination to a local area, e.g. illumination only to a screen (e.g. of a monitor of desktop computers, notebook computers and so on), a lamp nearby is used for the required illumination in general. Currently, lamps capable of being fixed on monitors for use are available on the market. For example, when a small USB lamp which includes a flexible tube, a USB connector at one end of the flexible tube, and a light source (e.g. LED) at the other end of the flexible tube is used for illumination, the USB connector is connected to a USB receptacle of a host (e.g. of desktop or notebook computers), and a user can bend the flexible tube such that the light source can be orientated toward a monitor for illuminating the screen of the monitor. At the moment, the whole lamp is supported only by the USB connector. Because the length of the flexible tube is limited, the light source cannot be shifted too far away from the monitor, resulting in that the illumination area by the light source is limited accordingly. For another example, when a lamp with a clip is used, the weight of the whole lamp is supported through the clip. Because the clip is located at an end of the whole lamp, the clip is requested to be capable of offering enough clamping force so that the lamp can be firmly supported. Furthermore, the clip usually uses two opposite surfaces to clamp a frame edge of a monitor. In general, the clamping area by the clip is relatively large, so a portion of the screen of the monitor is probably covered by the clip, resulting in inapplicability of the lamp to monitors with a narrow frame. For another example, when a lamp which is fastened through double-sided tape is used, the weight of the whole lamp is supported through the double-sided tape. Because weight and moment that the double-sided tape can support is limited, the weight and volume of such lamps are relatively small. Accordingly, the light source thereof cannot be shifted too far away from the monitor, and the illumination area by the light source is limited. In addition, for the lamps with a clip that are fixed on the top of a casing of a monitor through the clip for use, when the light source of the lamp is detachable from the clip, the clip may need a mechanism, by which a user can easily install the light source on the clip, and which can clamp the casing firmly without covering the screen of the monitor.

SUMMARY OF THE INVENTION

An aspect of the invention is to provide a clamp lamp for clamping an outer casing of a monitor. The clamp lamp uses a C-shaped resilient clip for convenience of clamping a light source thereof.

A clamp lamp for clamping an outer casing of a monitor according to the invention includes a light source, a first clamping part, and a second clamping part. The first clamping part has a first holding portion and a C-shaped resilient clip connected to the first holding portion. The light source is clamped by the C-shaped resilient clip. The second clamping part has a second holding portion. The first holding portion and the second holding portion are movably connected with each other.

Another aspect of the invention is to provide a clamp lamp for clamping an outer casing of a monitor. The clamp lamp uses a C-shaped resilient clip for convenience of clamping a light source thereof, and a resilient part for assisting the clamping.

A clamp lamp for clamping an outer casing of a monitor according to the invention includes a light source, a first clamping part, a resilient part, and a second clamping part. The first clamping part has a first holding portion and a C-shaped resilient clip connected to the first holding portion. The light source is clamped by the C-shaped resilient clip. The light source provides a light in front of a screen of the monitor. The second clamping part has a second holding portion. The first holding portion and the second holding portion are movably connected with each other. Therein, the resilient part is disposed where the first holding portion and the second holding portion are connected, for making the first holding portion and the second holding portion approach each other.

Another aspect of the invention is to provide a clamp lamp for clamping an outer casing of a monitor. The clamp lamp uses two clamping parts for clamping the outer casing stably by touching front and rear surfaces of the outer casing simultaneously.

A clamp lamp for clamping an outer casing of a monitor according to the invention includes a first clamping part and a second clamping part. The outer casing has a front surface, a rear surface, and an upper surface connecting the front surface and the rear surface. The first clamping part has a first holding portion and a light source connected to the first holding portion. The light source provides a light in front of the front surface. The first holding portion includes an abutting portion. The second clamping part has a second holding portion. The first holding portion and the second holding portion are movably connected with each other. The abutting portion is shorter than the second holding portion. Therein, when the clamp lamp clamps the outer casing, the abutting portion touches the front surface, and the second holding portion touches the rear surface.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
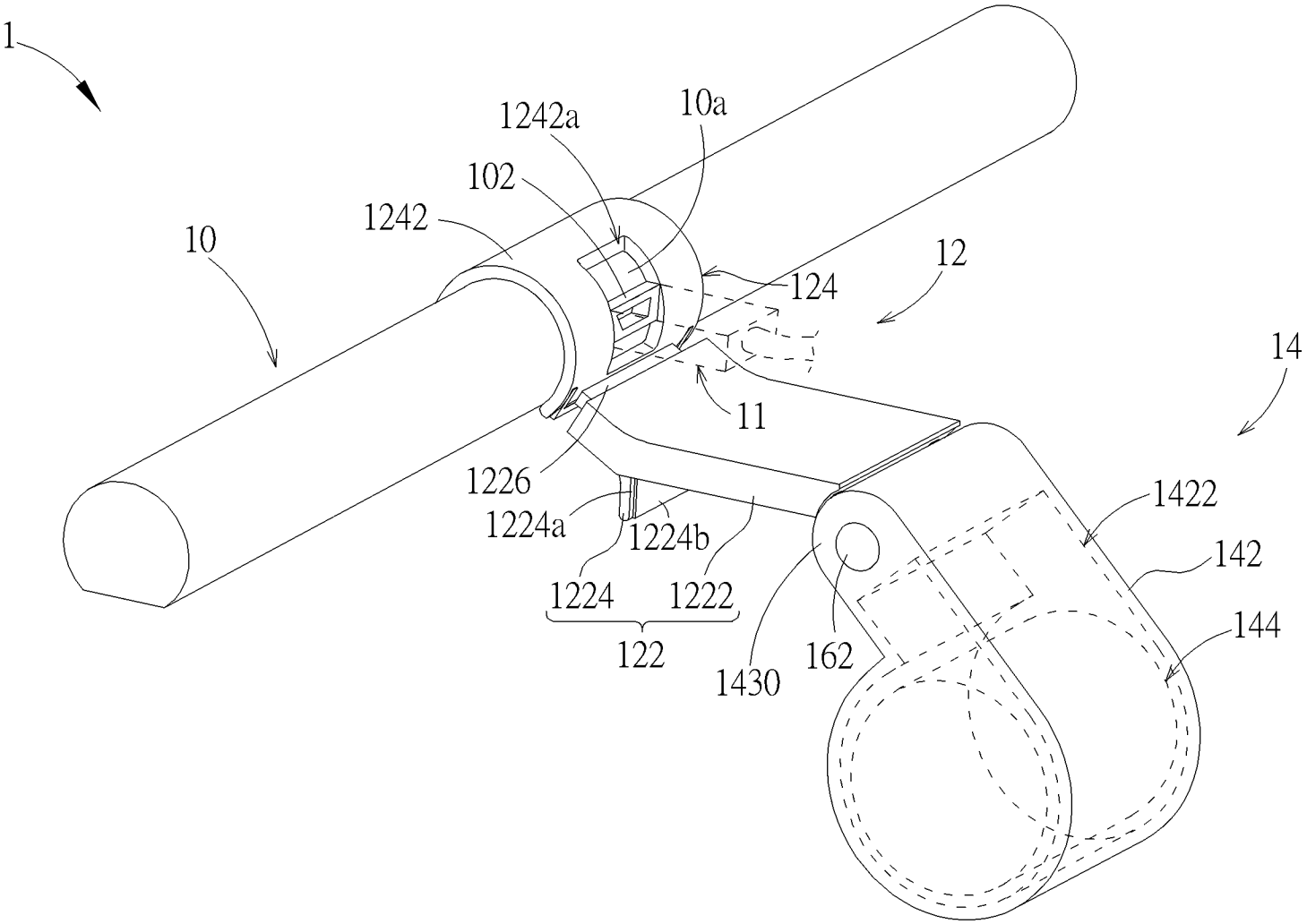
FIG. 1 is a schematic diagram illustrating a clamp lamp of an embodiment according to the invention.
Figure 2:
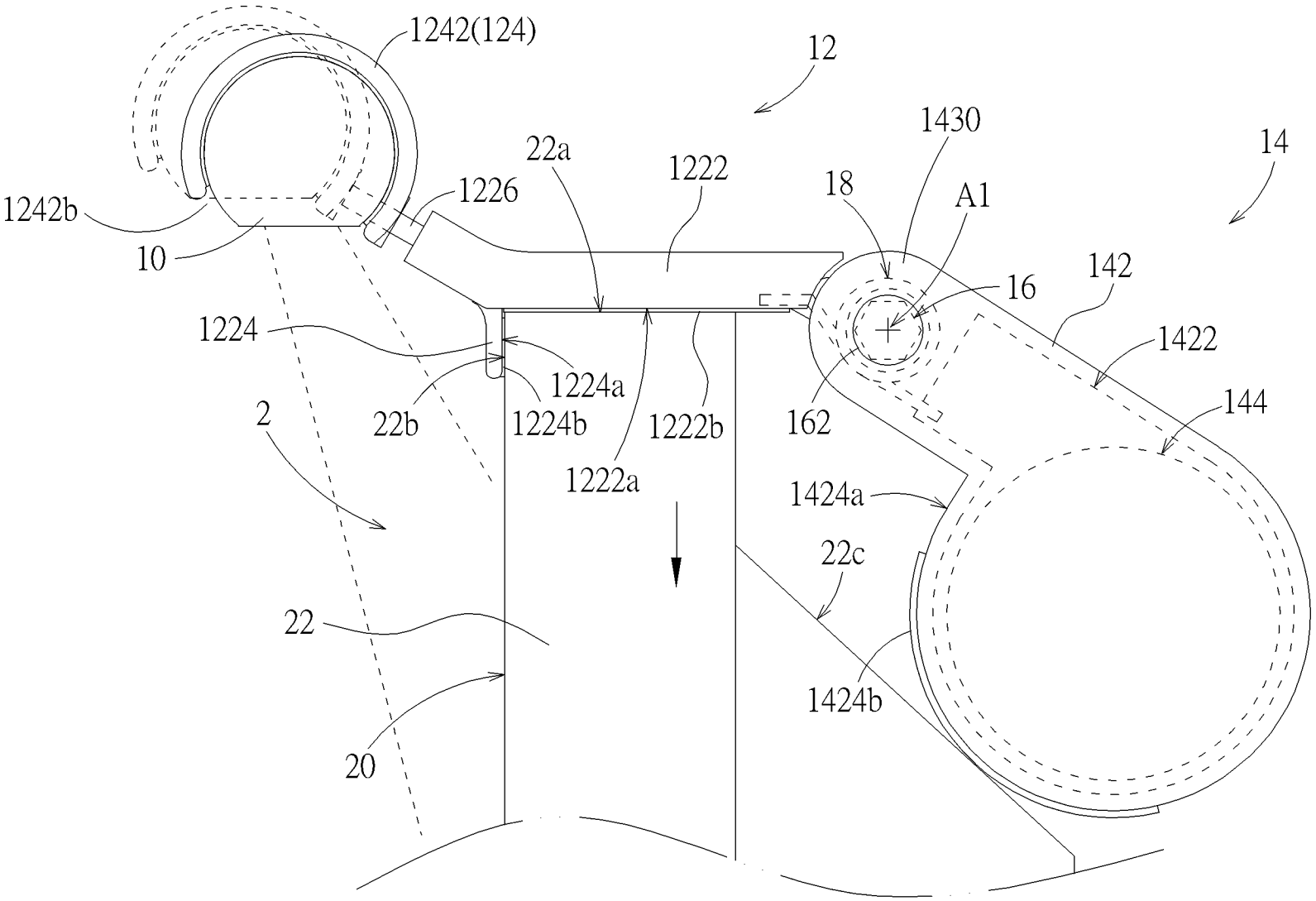
FIG. 2 is a side view of the clamp lamp in FIG. 1 when disposed on a monitor.

Please refer to FIG. 1 and FIG. 2. A clamp lamp 1 of an embodiment according to the invention includes a light source 10, a first clamping part 12, and a second clamping part 14. The first clamping part 12 has a first holding portion 122 and a lamp connecting portion 124 connected to the first holding portion 122. The light source 10 is connected to the lamp connecting portion 124. The second clamping part 14 has a second holding portion 142 and a counterweight 144 (shown in hidden lines the figures) disposed on the second holding portion 142. The first holding portion 122 and the second holding portion 142 are movably connected with each other. Thereby, when the clamp lamp 1 is disposed on a monitor 2 (for example but not limited to a monitor on a table), the light source 10 can provide illumination (indicated by dashed lines in FIG. 2) to a screen of the monitor 2; therein, the light source 10 has a socket 102 on a surface 10*a* thereof, for receiving an external electric power. The light source 10 receives external electric power through an electrical connection cable 11 (shown in dashed lines in FIG. 1) inserted into the socket 102 (e.g. from a notebook computer, a desktop computer, or a device or connection interface capable of providing electric power). In the installation of the clamp lamp 1, the first holding portion 122 is placed on an outer casing 22 of the monitor 2. Because the counterweight 144 and the lamp connecting portion 124 are located at two sides of the connection of the first holding portion 122 and the second holding portion 142 relative to a gravity direction (indicated by an arrow in FIG. 2), the counterweight 144 makes the first holding portion 122 and the second holding portion 142 approach each other to clamp the outer casing 22. Therein, in the embodiment, the first holding portion 122 and the second holding portion 142 are pivotally connection. A pivot axis A1 therefor is indicated by a cross mark in FIG. 2. Therefore, in the viewpoint of FIG. 2, the counterweight 144 (or the second clamping part 14) produces a clockwise moment relative to the pivot axis A1; the light source 10 (or the light source 10 together with the first clamping part 12) produces a counterclockwise moment relative to the pivot axis A1. The two moments make the first holding portion 122 and the second holding portion 142 approach each other. Furthermore, the two moments are opposite, which can reduce the torque that the fixing structure of the clamp lamp 1 (including the first holding portion 122 and the second holding portion 142 in the embodiment) sustains. It can be obtained by a static force analysis and will not be described in addition. In other words, when the first clamping part 12 and the second clamping part 14 clamp an object (e.g. an upper side of the outer casing 22), the counterweight 144 and the lamp connecting portion 124 are located at two sides of the object (i.e. the outer casing 22), which is conducive to reduction of the torque that the fixing structure of the clamp lamp 1 sustains and which also makes an extension line of the gravity center of the clamp lamp 1 pass through or close to an upper surface 22*a* of the outer casing 22 such that the clamping force of the first clamping part 12 and the second clamping part 14 to the outer casing 22 can substantially prevent the clamp lamp 1 from moving (including rotating) relative to the outer casing 22 (therein, when the gravity center of the clamp lamp 1 passes through the upper surface 22*a* of the outer casing 22, the clamp lamp 1 will not rotate relative to the outer casing 22). In addition, the weight of the counterweight 144 can depend on the weight of the light source 10 and the position of the clamp lamp 1 in use relative to the outer casing 22. For example, the counterweight 144 and the light source 10 are equal in weight. The light source 10 emits light by using but not limited to light-emitting diodes.

Figure 3:
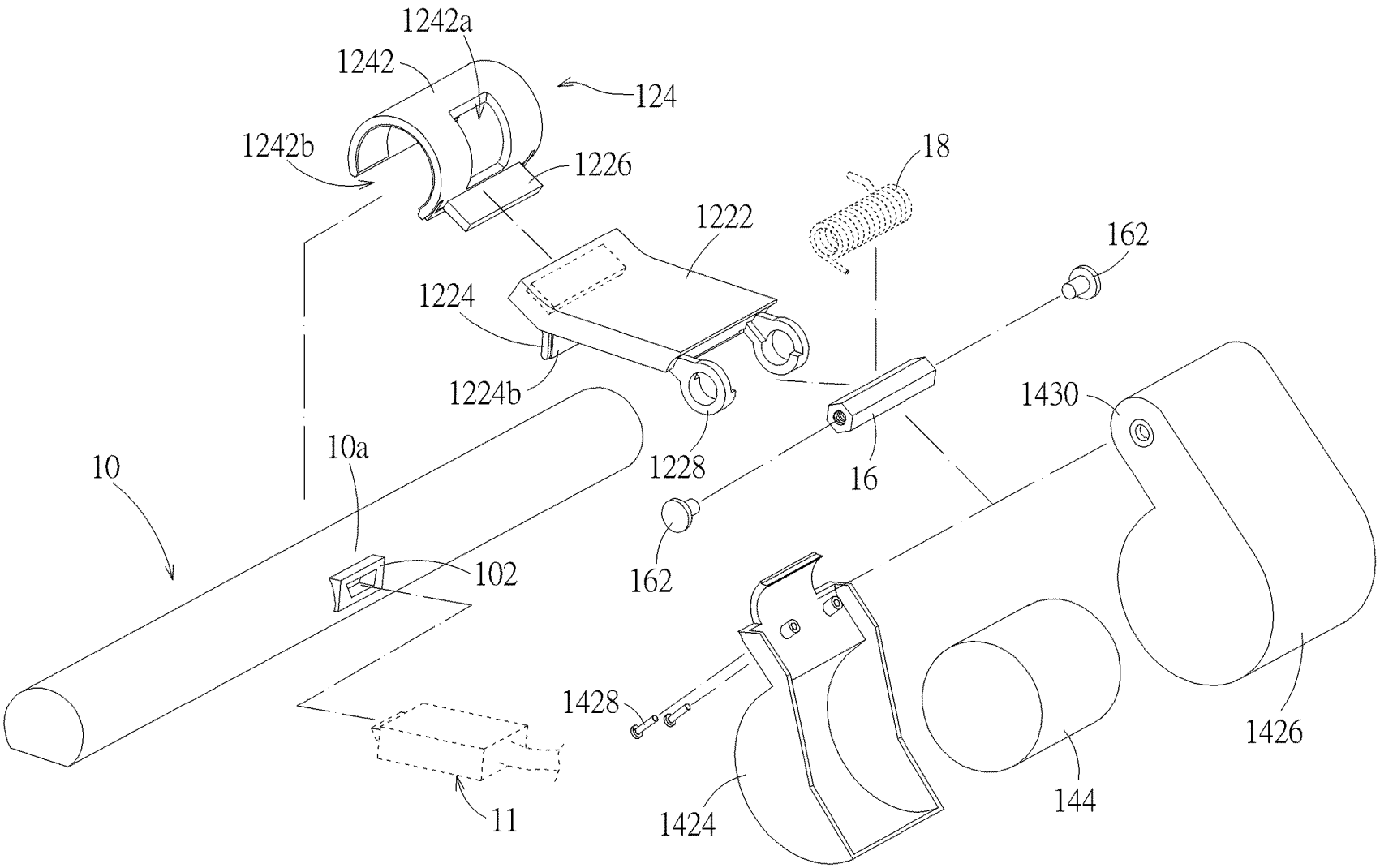
FIG. 3 is an exploded view of the clamp lamp in FIG. 1.

Please also refer to FIG. 3. Furthermore, in the embodiment, the first holding portion 122 has a supporting portion 1222 and an abutting portion 1224 protruding from the supporting portion 1222. The first holding portion 122 is connected with the second holding portion 142 through the supporting portion 1222. When the clamp lamp 1 is disposed on the outer casing 22, the supporting portion 1222 and the abutting portion 1224 contact the upper surface 22*a* and the front surface 22*b* of the outer casing 22 respectively; therein, the abutting portion 1224 can prevent the second clamping part 14 from dragging the first clamping part 12 rightward due to the counterweight 144 in the viewpoint of FIG. 2. In practice, the supporting portion 1222 has a slip-proof pad 1222*b* on a surface 1222*a* thereof that is used to abut against the upper surface 22*a* of the outer casing 22; the abutting portion 1224 have a slip-proof pad 1224*b* (taken as a first slip-proof pad) on a surface 1224*a* thereof that is used to abut against the front surface 22*b* of the outer casing 22. The slip-proof pads 1222*b* and 1224*b* can increase the friction forces between the outer casing 22 and the supporting portion 1222 and the abutting portion 1224 respectively, which is conducive to a stable disposition of the clamp lamp 1 on the outer casing 22. In practice, the slip-proof pads 1222*b* and 1224*b* can be but not limited to rubber pads. In addition, the supporting portion 1222 and the abutting portion 1224 without slip-proof pads 1222*b* and 1224*b* can be formed in a single piece and perpendicular to each other.

Figure 4:
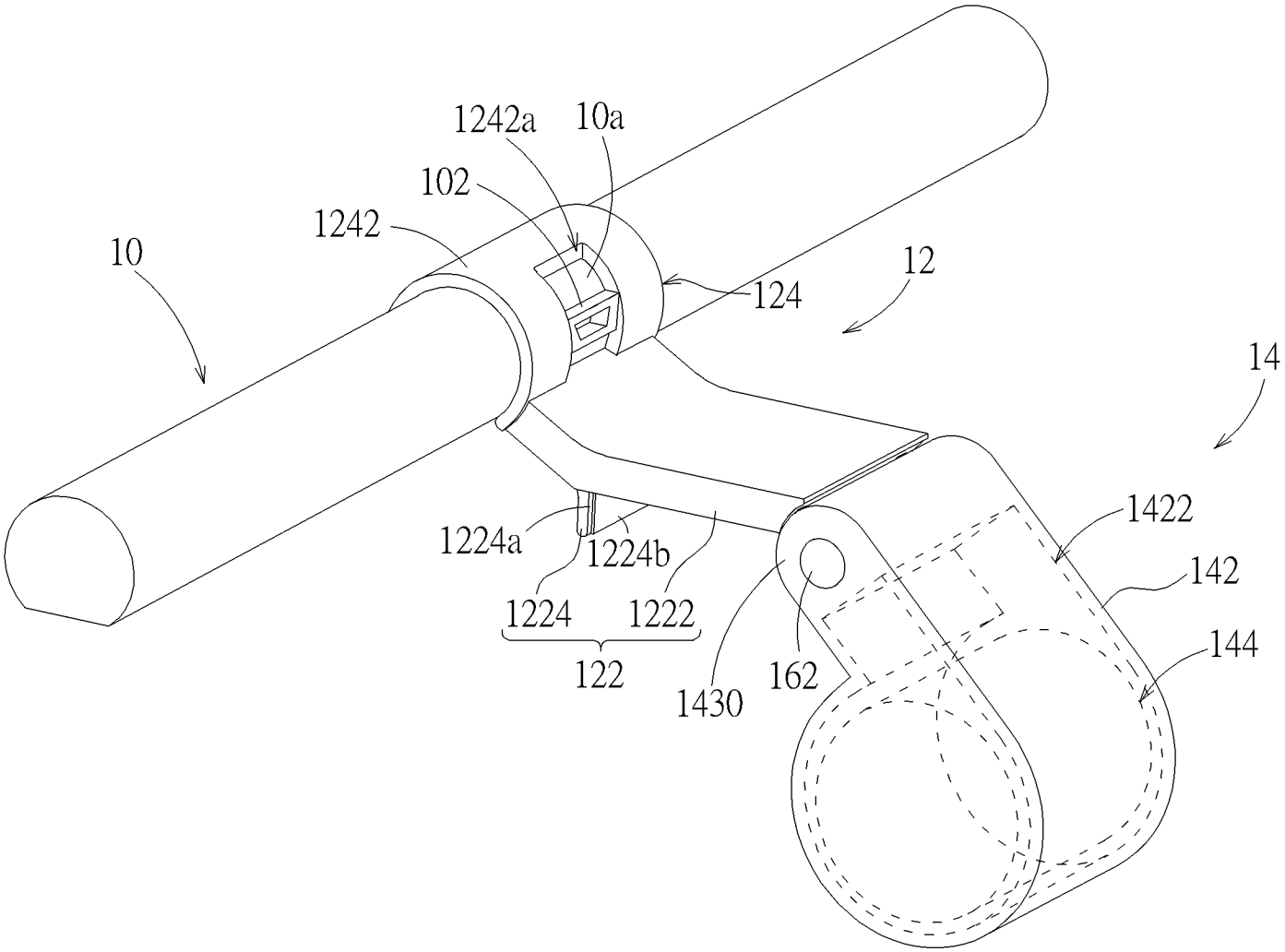
FIG. 4 is a schematic diagram illustrating a clamp lamp of another embodiment.

In the embodiment, the lamp connecting portion 124 includes a C-shaped resilient clip 1242. The light source 10 is clamped by the C-shaped resilient clip 1242 and provides light projected from an opening 1242*b* of the C-shaped resilient clip 1242. The first holding portion 12 includes a first sliding part 1226 and a second sliding part. The first sliding part 1226 is connected to the C-shaped resilient clip 1242 of the lamp connecting portion 124. The first sliding part 1226 and the second sliding part are restrictedly slidably connected with each other. In the embodiment, the supporting portion 1222 also serves as the second sliding part, so the second sliding part is connected to the second holding portion 142; however, the invention is not limited thereto. In the embodiment, the sliding connection of the first sliding part 1226 with the second sliding part (i.e. the supporting portion 1222) is obtained by inserting the first sliding part 1226 into an insertion slot (shown in hidden lines in FIG. 3) formed on the supporting portion 1222; however, the invention is not limited thereto. In practice, the first sliding part 1226 and the second sliding part (i.e. the supporting portion 1222) can be relatively positioned by friction force. The magnitude of the friction force can be determined such that a user is allowed to move the first sliding part 1226 for adjusting the distance between the light source 10 and the screen 29. When the clamp lamp 1 is in use, the user can move the first sliding part 1226 relative to the second sliding part (i.e. the supporting portion 1222) for adjusting the distance between the light source 10 and the first holding portion 122 or the object (i.e. the outer casing 22), i.e. the distance between the light source 10 and the screen 20, as shown by the lamp connecting portion 124 in dashed lines in FIG. 2. Furthermore, in the embodiment, the light source 10 is rotatably clamped by the C-shaped resilient clip 1242. Therein, the C-shaped resilient clip 1242 has a limitation slot 1242*a*. The socket 102 is slidably disposed in the limitation slot 1242*a*. Thereby, by the coordination of the socket 102 with the limitation slot 1242*a*, the angular range within which the light source 10 can rotate relative to the C-shaped resilient clip 1242 is limited. From another structural logic, the limitation slot 1242*a* and the socket 102 can be regarded as a limitation structure of the clamp lamp 1, for limiting an angular range of the light source 10; therein, the socket 102 is taken as a protrusion on the light source 10. Therefore, the angular range of the light source 10 relative to the C-shaped resilient clip 1242 is limited by the protrusion (i.e. the socket 102) within the limitation slot 1242. Furthermore, in practice, it is practicable to attach the light source 10 onto the C-shaped resilient clip 1242 in a fixed relative angle. In addition, in practice, the lamp connecting portion 124 and the first holding portion 122 can be formed in a single piece, e.g. by plastic injection molding, as shown by FIG. 4.

Please back to FIG. 1 to FIG. 3. In the embodiment, the second holding portion 142 has an accommodating room 1422 (shown in dashed lines in FIG. 1 and FIG. 2). The counterweight 144 is accommodated in the accommodating room 1422. Therein, the second holding portion 142 includes a first casing 1424 and a second casing 1426. The first casing 1424 and the second casing 1426 are engaged with each other to form the accommodating room 1422. In the embodiment, the second holding portion 142 further includes a fastening part 1428, which fastens the first casing 1424 and the second casing 1426 together so that the counterweight 144 can be disposed in the accommodating room 1422 firmly. Therein, the fastening part 1428 is achieved by two screws, but the invention is not limited thereto. When the clamp lamp 1 is disposed on the outer casing 22, the second holding portion 142 contacts the outer casing 22. Similarly, in practice, the second holding portion 142 has a slip-proof pad 1424*b* (taken as a second slip-proof pad) on a surface thereof (i.e. a surface 1424*a* of the first casing 1424) that is used for abutting against the rear surface 22*c* of the outer casing 22, for increasing the friction force between the second holding portion 142 and the outer casing 22, which is conducive to a stable disposition of the clamp lamp 1 on the outer casing 22.

Furthermore, in the embodiment, the first holding portion 122 and the second holding portion 142 are pivotally. Therein, the first holding portion 122 has a first pivotal connection portion 1228 disposed on the supporting portion 1222. The second holding portion 142 has a second pivotal connection portion 1430 disposed on the second casing 1426. The first pivotal connection portion 1228 and the second pivotal connection portion 1430 are pivotally connected through a pivot axle 16 (shown in dashed lines in FIG. 2). The pivot axle 16 passes through the first pivotal connection portion 1228 and the second pivotal connection portion 1430. A fixing part 162 is attached onto each end of the pivot axle 16, such that the first pivotal connection portion 1228 and the second pivotal connection portion 1430 can be constrained between the two fixing parts 162 and stably pivotally connected.

Figure 5:
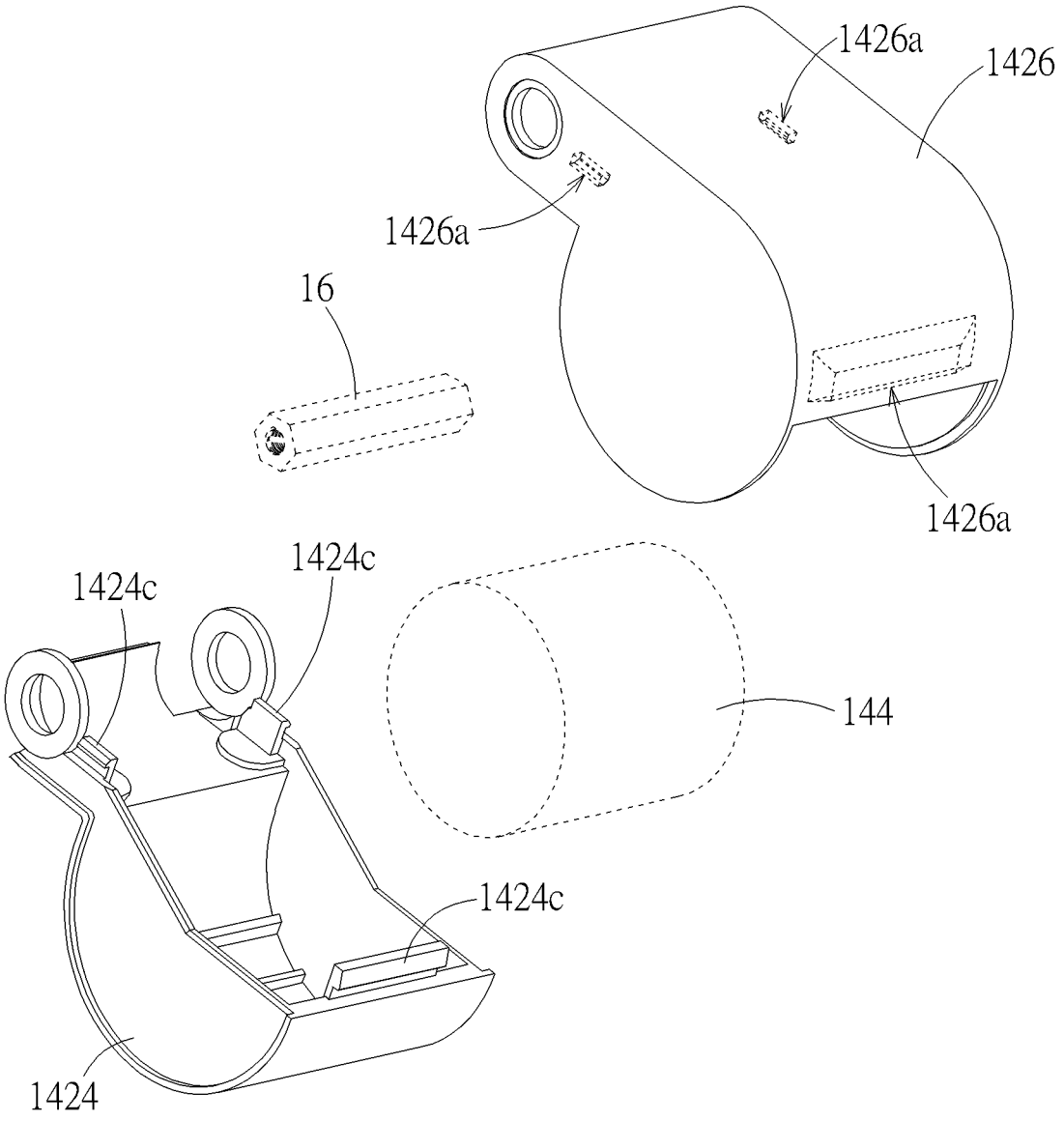
FIG. 5 is an exploded view of a second holding portion of another embodiment.

In addition, in practice, the first casing 1424 and the second casing 1426 can be engaged with each other by other methods. For example, as shown by FIG. 5, the first casing 1424 includes a first engagement part 1424*c* (achieved by three hooks). The second casing 1426 includes a second engagement part 1426*a* (achieved by one lock slot and two protrusive blocks, of which the profiles are shown in hidden lines in FIG. 5). The first casing 1424 and the second casing 1426 are joined by engaging the first engagement part 1424*c* with the second engagement part 1426*a* (i.e. the three hooks hooking the lock slot and the two protrusive blocks respectively). In this case, the fastening part 1428 in FIG. 3 can be skipped; however, in practice, the first casing 1424 and the second casing 1426 can be engaged by the above two joining structures at the same time. Furthermore, as shown in FIG. 5, the first casing 1424 and the second casing 1426 are also pivotally connected through the pivot axle 16 (shown in dashed lines in the figure). In other words, without the engagement of the first engagement part 1424*c* and the second engagement part 1426*a*, the first casing 1424 and the second casing 1426 can relatively pivot about the pivot axle 16. Such structural configuration is convenient for the user to attach or detach the counterweight 144 (shown in dashed lines in the figure). For example, the user can apply force directly to the first casing 1424 and the second casing 1426 so as to separate the first engagement part 1424*c* from the second engagement part 1426*a*. At the moment, the second holding portion 142 is open, and then, the user can attach or detach the counterweight 144. Similarly, the user can make the first casing 1424 and the second casing 1426 relatively rotate and close to each other so as to engaging the first engagement part 1424*c* with the second engagement part 1426*a*.

Please refer back to FIG. 1 to FIG. 3. In the embodiment, when in use, the clamp lamp 1 uses the counterweight 144 to make the first holding portion 122 and the second holding portion 142 approach each other. In practice, the clamp lamp 1 can further include a resilient part 18 (shown in dashed lines in FIG. 2 and FIG. 3) which is disposed where the first holding portion 122 and the second holding portion 142 are pivotally connected and makes the first holding portion 122 and the second holding portion 142 approach each other. In the embodiment, the resilient part 18 is a torsion spring sleeved on the pivot axle 16. Two ends of the torsion spring abut against the first holding portion 122 and the second holding portion 142 respectively; however, the invention is not limited thereto. For example, it is practicable to use a tension spring, of which two ends are fixed to the first holding portion 122 and the second holding portion 142 respectively, so as to make the first holding portion 122 and the second holding portion 142 approach each other.

Figure 6:
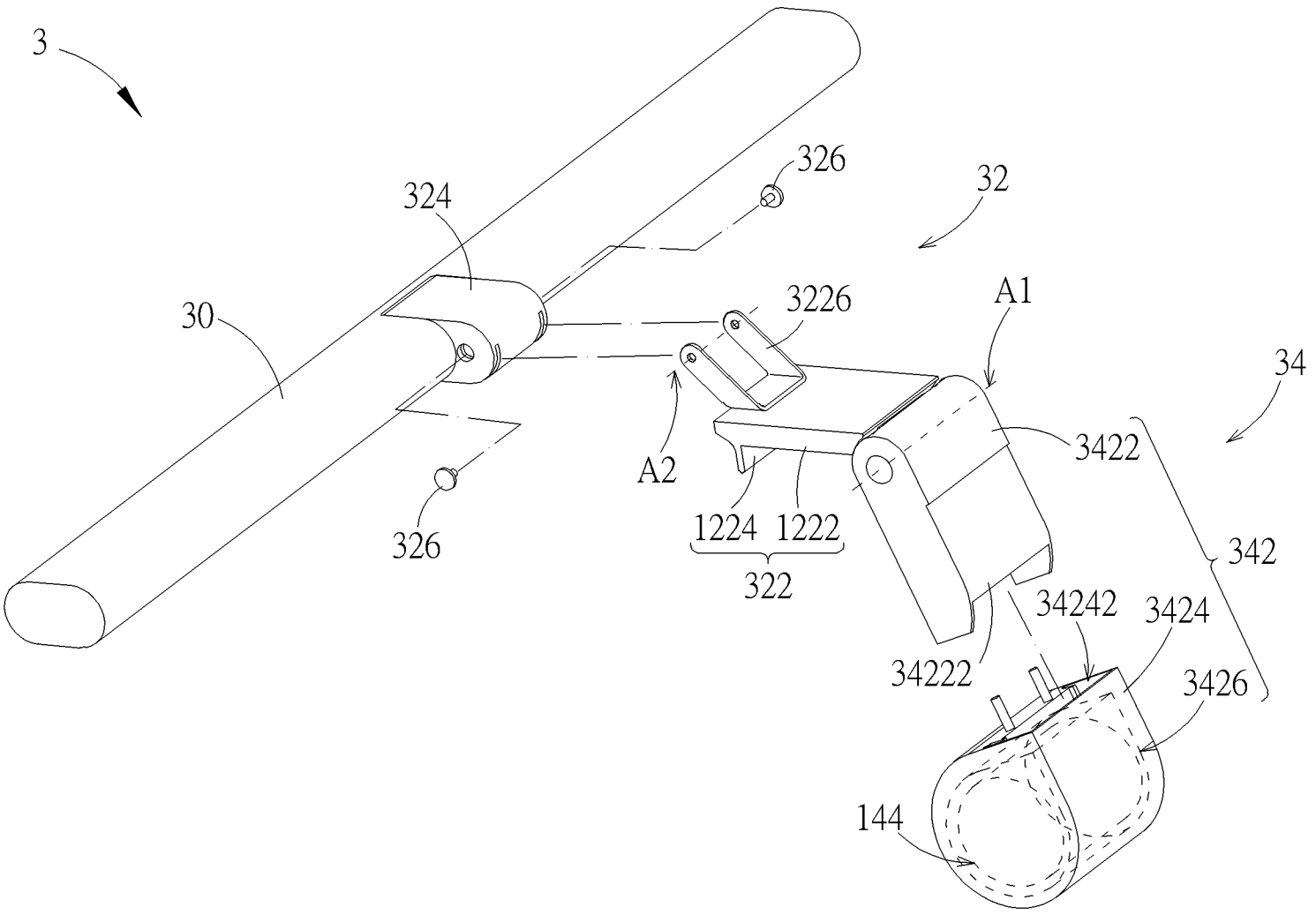
FIG. 6 is a partially exploded view of a clamp lamp of another embodiment.

In addition, in the embodiment, the disposition angle of the light source 10 can be adjusted through the C-shaped resilient clip 1242 having the limitation slot 1242*a*, but the invention is not limited thereto. As shown by FIG. 6, a clamp lamp 3 of another embodiment is substantially structurally similar to the clamp lamp 1 and uses the reference numbers of the clamp lamp 1 in principle. For other descriptions about the clamp lamp 3, please refer to the relevant descriptions of the clamp lamp 1, which will not be described in addition. A difference between the clamp lamp 3 and the clamp lamp 1 is that a first holding portion 322 of a first clamping part 32 of the clamp lamp 3 includes a pivotal connection mount 3226. A connecting portion 324 of the clamp lamp 3 is pivotally connected with the pivotal connection mount 3226 (e.g. by but not limited to two screws 326). A pivot axis A2 therefor is shown in dashed lines in FIG. 6. Thereby, a light source 30 of the clamp lamp 3 which is connected to the connecting portion 324 can rotate relative to the pivotal connection mount 3226 through the lamp connecting portion 324 for angular adjustment. In the embodiment, the pivot axis A2 and the pivot axis A1 (both shown in dashed lines in FIG. 6) are parallel.

Furthermore, in the clamp lamp 1, the distance between the counterweight 144 and the pivot axis A1 (or the pivot axle 16) is fixed; however, the invention is not limited thereto. As shown by FIG. 6, a second holding portion 342 of a second clamping part 34 of the clamp lamp 3 includes a third sliding part 3422 and a fourth sliding part 3424. The third sliding part 3422 and the fourth sliding part 3424 are restrictedly slidably connected with each other. The counterweight 144 is disposed on the fourth sliding part 3424. Therein, the third sliding part 3422 and the supporting portion 1222 of the first holding portion 322 are pivotally connected. The third sliding part 3422 has an insertion portion 34222. The fourth sliding part 3424 has an insertion slot 34242 correspondingly. The insertion portion 34222 is movably inserted into the insertion slot 34242. In practice, the fixing and adjusting of the insertion portion 34222 and the insertion slot 34242 can be performed by friction force, the coordination of a nut (rotatably disposed on the insertion portion 34222) and a leadscrew (fixed on the fourth sliding part 3424 and meshing with the nut), and so on. The second holding portion 342 has an accommodating room 3426 in the fourth sliding part 3424 (or formed by the fourth sliding part 3424, shown in hidden lines in FIG. 6). The counterweight 144 (shown in hidden lines in FIG. 6) is accommodated in the accommodating room 3426. Thereby, by adjusting the relative position of the third sliding part 3422 to the fourth sliding part 3424, the distance from the counterweight 144 to the pivot axis A1 (or the pivot axle 16), the object (i.e. the outer casing 22), or the light source 30 is adjusted.

Figure 7:
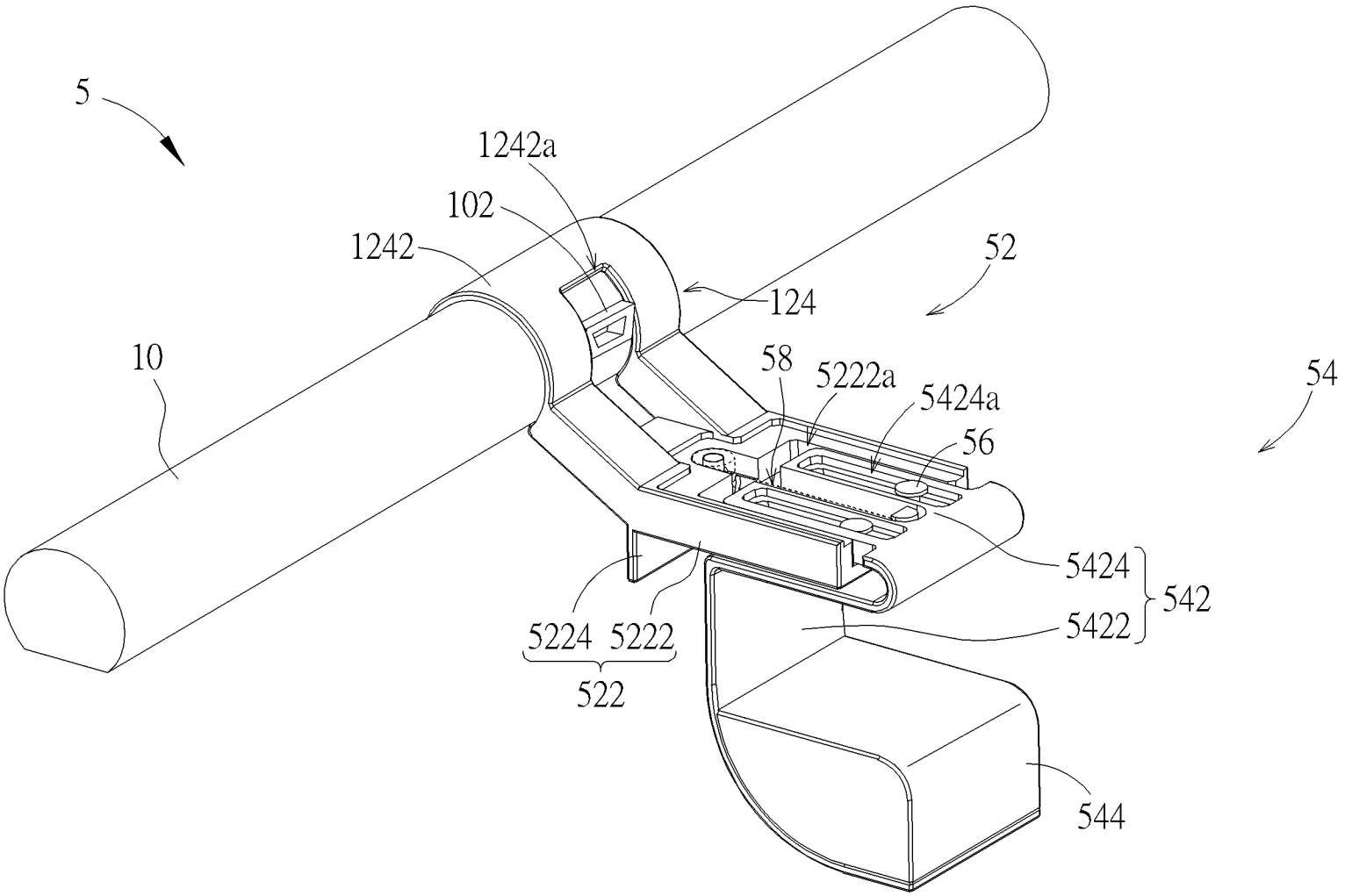
FIG. 7 is a schematic diagram illustrating a clamp lamp of another embodiment.
Figure 8:
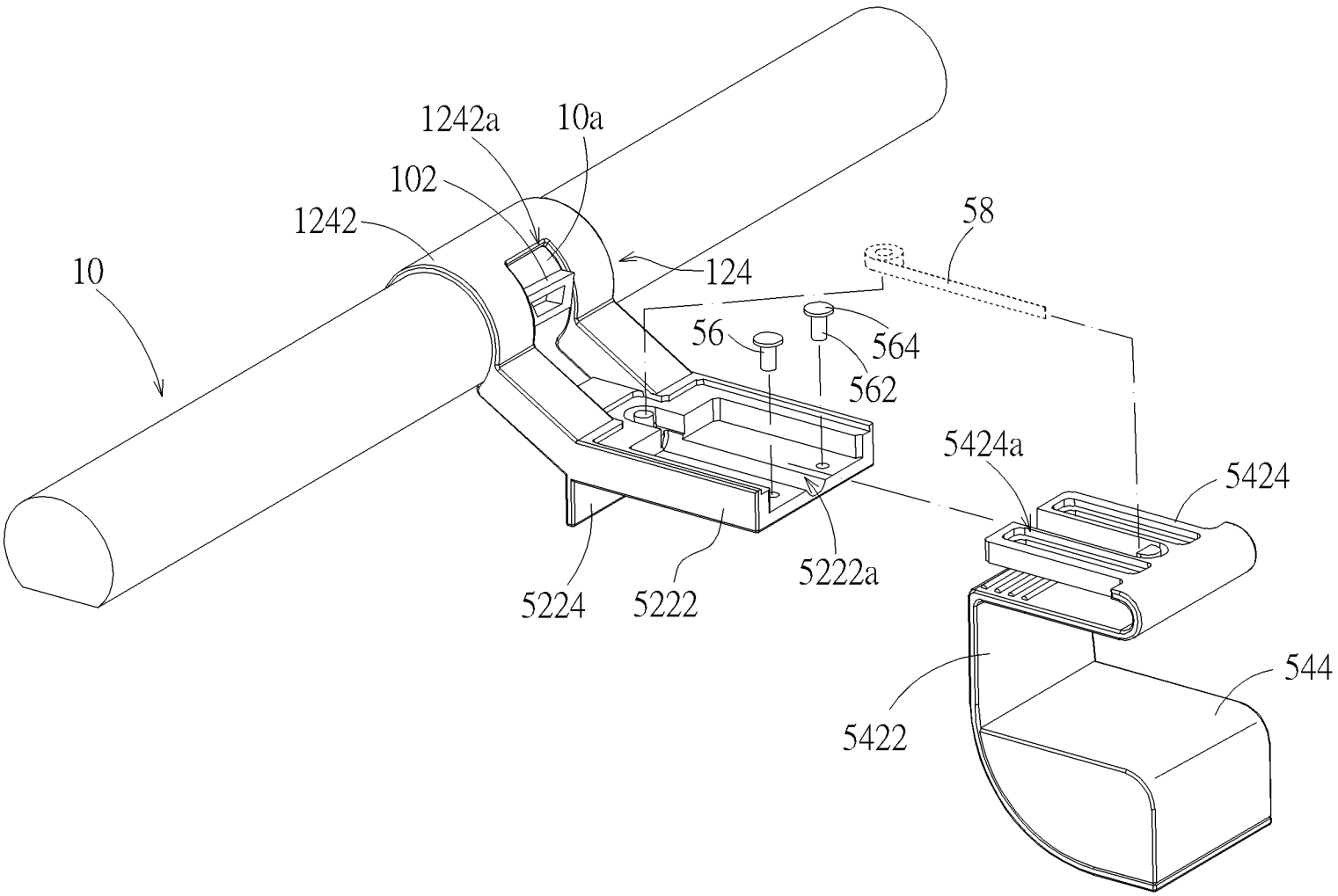
FIG. 8 is a partially exploded view of the clamp lamp in FIG. 7.

In the above embodiments, the movable connection of the first holding portions 122 and 322 and the second holding portions 142 and 342 is achieved by pivotally connection; however, the invention is not limited thereto. As shown by FIG. 7 and FIG. 8, a clamp lamp 5 of another embodiment is substantially structurally similar to the clamp lamp 1 and uses the reference numbers of the clamp lamp 1 in principle. For other descriptions about the clamp lamp 5, please refer to the relevant descriptions of the clamp lamp 1, which will not be described in addition. In the clamp lamp 5, a first clamping part 52 and a second clamping part 54 thereof are movably connected with each other by slidable connection. A first holding portion 522 of the first clamping part 52 and a second holding portion 542 of the second clamping part 54 are restrictedly slidably connected with each other. The first holding portion 522 has a supporting portion 5222 and an abutting portion 5224 protruding from the supporting portion 5222. The first holding portion 522 is restrictedly slidably connected with the second holding portion 542 through the supporting portion 5222. Therein, the supporting portion 5222 has a sliding slot 5222*a*. The second holding portion 542 includes a main body 5422 and a sliding portion 5424 connected to the main body 5422. The sliding portion 5424 slides in the sliding slot 5222*a*. A counterweight 544 is fixed on the main body 5422 (e.g. by but not limited to screwing, adhering and so on). In the embodiment, the clamp lamp 5 includes two guiding posts 56. The guiding post 56 has a post body 562 and a constraint portion 564 at an end of the post body 562. The post body 562 passes through a slot hole 5424*a* of the sliding portion 5424 and is fixed in the sliding slot 5222*a* through the other end thereof. The constraint portion 564 constrains the sliding portion 5424 to slide in the sliding slot 5222*a*. Thereby, by adjusting the relative position of the sliding portion 5424 and the sliding slot 5222*a*, the distance between the main body 5422 and the abutting portion 5224 can be adjusted for adaptation to the outer casing 22 with different thickness. Furthermore, a change of the relative position of the sliding portion 5424 and the sliding slot 5222*a* will change the distance between the counterweight 544 and the light source 10.

In addition, in the embodiment, the clamp lamp 5 can further include a resilient part 58 (shown in dashed lines in FIG. 7 and FIG. 8) which is connected to the supporting portion 5222 and the second holding portion 542 so as to make the abutting portion 5224 and the second holding portion 542 approach each other. In practice, the resilient part 58 can be a constant-force spring (as shown by FIG. 7 and FIG. 8) or a tension spring disposed in the sliding slot 5222*a*. One end thereof is connected to the supporting portion 5222; the other end thereof is connected to the sliding portion 5424.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A clamp lamp for clamping an outer casing of a monitor, the outer casing having a front surface, a rear surface, and an upper surface connecting the front surface and the rear surface, the clamp lamp comprising:

a light source;

a first clamping part, the first clamping part having a first holding portion and a lamp connecting portion, the first holding portion having a first end portion and a second end portion, the lamp connecting portion connected to the first end portion, the light source being connected by the lamp connecting portion; and a second clamping part, the second clamping part having a second holding portion, the second holding portion being movably connected to the second end portion of the first holding portion, wherein when the clamp lamp clamps the outer casing, the first end portion protrudes upward from the front surface and the upper surface, and the light source is above the upper surface and the front surface.

2. The clamp lamp of claim 1, wherein the lamp connecting portion is a C-shaped resilient clip, the light source provides a light projected from a gap of the C-shaped resilient clip.

3. The clamp lamp of claim 2, wherein the light source is rotatable relative to the C-shaped resilient clip for adjusting an angle of the light projected from the gap.

4. The clamp lamp of claim 3, further comprising a limitation structure for limiting an angular range of the light source.

5. The clamp lamp of claim 4, the limitation structure comprising a limitation slot on the C-shaped resilient clip and a protrusion on the light source, wherein the angular range of the light source relative to the C-shaped resilient clip is limited by the protrusion within the limitation slot.

6. The clamp lamp of claim 1, wherein the light source has a long main casing, the lamp connecting portion is connected to a middle portion of the long main casing, and when the clamp lamp is disposed on the outer casing of the monitor, the long main casing extends in a left-right direction relative to the outer casing.

7. The clamp lamp of claim 1, wherein the first holding portion has a first slip-proof pad, the second holding portion has a second slip-proof pad, and when the clamp lamp is disposed on the outer casing, the first slip-proof pad abuts against the front surface, and the second slip-proof pad abuts against the rear surface.

8. The clamp lamp of claim 1, wherein the lamp connecting portion is pivotally connected to the first holding portion.

9. The clamp lamp of claim 1, the second clamping part further comprising a counterweight disposed on the second holding portion, wherein when the first clamping part and the second clamping part clamp the outer casing, the counterweight and the light source are located at two sides of the outer casing.

10. The clamp lamp of claim 1, wherein the light source has a socket on a surface of the light source, for receiving an external electric power.

11. The clamp lamp of claim 1, wherein the lamp connecting portion is a C-shaped resilient clip, and the C-shaped resilient clip and the first holding portion are formed in a single piece.

12. The clamp lamp of claim 1, the first holding portion further comprising a supporting portion and an abutting portion, wherein the supporting portion and the abutting portion are formed in a single piece and perpendicular to each other, an end portion of the supporting portion bends and extends in a direction away from the abutting portion, the second holding portion has a curved surface, and when the clamp lamp is disposed on the outer casing, the abutting portion touches the front surface, the second holding portion touches the rear surface through the curved surface, and the supporting portion is above the upper surface.

13. A clamp lamp for clamping an outer casing of a monitor, comprising:

a light source;

a first clamping part, the first clamping part having a first holding portion and a C-shaped resilient clip connected to the first holding portion, the light source being clamped by the C-shaped resilient clip, the light source providing a light in front of a screen of the monitor;

a resilient part; and a second clamping part, the second clamping part having a second holding portion, the first holding portion and the second holding portion being movably connected with each other, wherein the resilient part is disposed where the first holding portion and the second holding portion are connected, for making the first holding portion and the second holding portion approach each other.

14. The clamp lamp of claim 13, wherein the first holding portion has a first slip-proof pad, the second holding portion has a second slip-proof pad, the outer casing has a front surface and a rear surface, and when the clamp lamp is disposed on the outer casing, the first slip-proof pad abuts against the front surface, and the second slip-proof pad abuts against the rear surface.

15. The clamp lamp of claim 13, wherein the outer casing comprises a front surface, a rear surface, and an upper surface connecting the front surface and the rear surface, the first holding portion comprises a supporting portion that has an end portion bending and protruding upward, the C-shaped resilient clip is connected to the end portion, the light source has a long main casing clamped by the C-shaped resilient clip, and when the clamp lamp clamps the outer casing, the supporting portion is above the upper surface, the long main casing extends in a left-right direction relative to the outer casing, and the light source is raised by the first holding portion above the upper surface.

16. A clamp lamp for clamping an outer casing of a monitor, the outer casing having a front surface, a rear surface, and an upper surface connecting the front surface and the rear surface, the clamp lamp comprising:

a first clamping part, the first clamping part having a first holding portion and a light source connected to the first holding portion, the light source providing a light in front of the front surface, the first holding portion comprising an abutting portion; and a second clamping part, the second clamping part having a second holding portion, the first holding portion and the second holding portion being movably connected with each other, the abutting portion being shorter than the second holding portion, wherein when the clamp lamp clamps the outer casing, the abutting portion touches the front surface, and the second holding portion touches the rear surface.

17. The clamp lamp of claim 16, the first holding portion further comprises a supporting portion, wherein when the clamp lamp clamps the outer casing, the supporting portion is above the upper surface, and the second holding portion and the light source are located at two sides of the outer casing.

18. The clamp lamp of claim 16, further comprising a resilient part, wherein the resilient part is disposed where the first holding portion and the second holding portion are connected, for making the first holding portion and the second holding portion approach each other.

19. The clamp lamp of claim 18, wherein the first holding portion has a first slip-proof pad, the second holding portion has a second slip-proof pad, and when the clamp lamp is disposed on the outer casing, the first slip-proof pad abuts against the front surface, and the second slip-proof pad abuts against the rear surface.

20. The clamp lamp of claim 16, wherein the first holding portion has an end portion protruding upward from the front surface and the upper surface, the light source has a long main casing, a middle portion of the long main casing is connected to the end portion, and when the clamp lamp clamps the outer casing, the long main casing extends in a left-right direction relative to the outer casing, and the light source is raised by the first holding portion above the upper surface.

* * * * *